United States Patent [19]

Adkins

[11] Patent Number: 4,936,602

[45] Date of Patent: Jun. 26, 1990

[54] SKI POLE HOLDER

[76] Inventor: Keith W. Adkins, E. 1644 Nebraska, Spokane, Wash. 99207

[21] Appl. No.: 223,924

[22] Filed: Jul. 25, 1988

[51] Int. Cl.[5] ..... A63C 11/00

[52] U.S. Cl. ..... 280/809; 211/70.5; 280/814; 411/531

[58] Field of Search ..... 280/809, 814, 815; 248/110, 230; 211/70.5; 224/917, 42.45 R, 251; 294/147; 104/173.2; 297/188, 191, 194; 411/903, 531, 544, 908

[56] References Cited

U.S. PATENT DOCUMENTS

| | | | |
|---|---|---|---|
| 2,441,697 | 5/1948 | Gage | 248/110 |
| 3,504,405 | 4/1970 | Elliot-Smith | 280/814 |
| 3,958,251 | 5/1976 | Summey | 248/230 |
| 4,793,496 | 12/1988 | Wait | 211/70.5 |

FOREIGN PATENT DOCUMENTS

| | | | |
|---|---|---|---|
| 2918457 | 11/1980 | Fed. Rep. of Germany | 211/70.5 |
| 2434055 | 4/1980 | France | 224/917 |
| 2496029 | 6/1982 | France | 104/173.2 |
| 635532 | 4/1983 | Switzerland | 280/809 |
| 1455235 | 11/1976 | United Kingdom | 411/531 |

*Primary Examiner*—Charles A. Marmor
*Assistant Examiner*—Eric C. Culbretz
*Attorney, Agent, or Firm*—Klarquist, Sparkman, Campbell, Leigh & Whinston

[57] ABSTRACT

A ski pole holder is mounted to a ski lift and secures a skier's ski poles during the ski lift ride. The holder is resilient and includes a formation for slidably receiving the rod section of a ski pole and supporting the pole handle from below.

13 Claims, 2 Drawing Sheets

SKI POLE HOLDER

BACKGROUND OF THE INVENTION

The present invention relates generally to ski equipment and particularly a ski pole holder for attachment to a ski lift.

Skiers, who ride ski lifts to the top of a ski run, must often carry their ski poles in hand or sit upon the poles as they ride. Some ski poles are provided with handles adapted to hang from the frame of the ski lift, but most ski poles do not have this capability. It is important to keep a firm hold on the ski poles during the ski lift ride, for if the poles fall to the ground the skier has no way immediately to retrieve the poles. For most skiers the ski lift ride offers an opportunity to prepare for the next run: examples of such activities include adjustment of ski clothing, application of lip ointment, and cleaning foggy goggles. These activities are hampered by the need to keep a firm hold on the ski poles, and many skiers drop their poles.

SUMMARY OF THE PRESENT INVENTION

In accordance with a principal embodiment of the present invention, a ski pole holder attaches to a ski lift and includes a formation for slidably receiving a rod section of a ski pole while supporting the ski pole handle from below so as to permit the ski pole to hang upon the holder during a ski lift ride.

In accordance with a second aspect of the present invention, the pole holder is resilient such that in the event that the poles drag upon the ground or strike an object, the poles will not bend or fall from the holder. The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
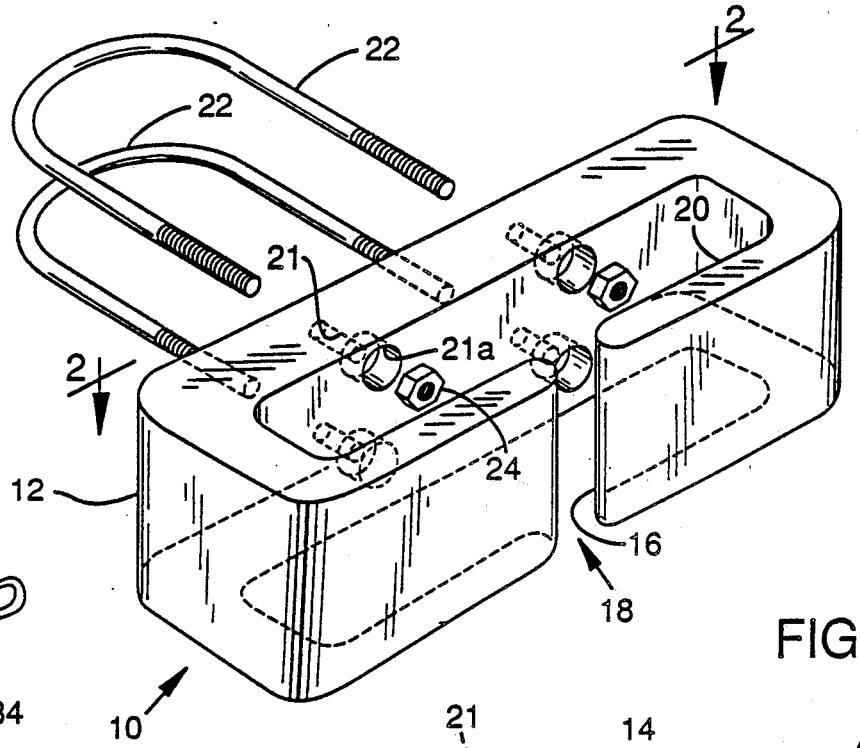
FIG. 1 is an exploded perspective view of a ski pole holder according to the present invention.
Figure 2:
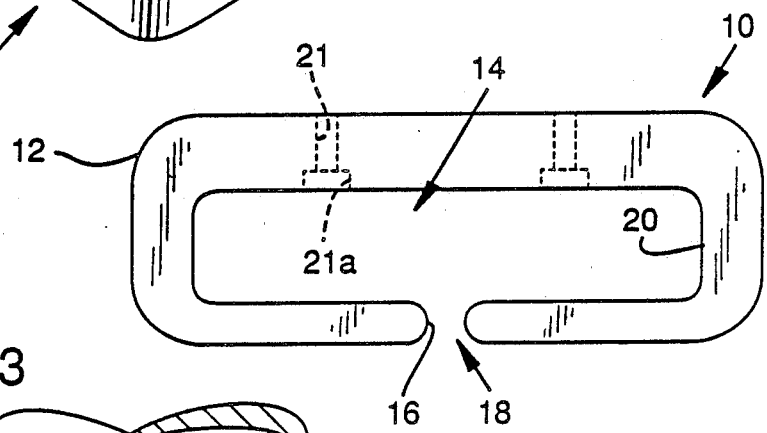
FIG. 2 is a top view taken along lines 2—2 of FIG. 1 of a portion of the ski pole holder shown in FIG. 1.
Figure 3:
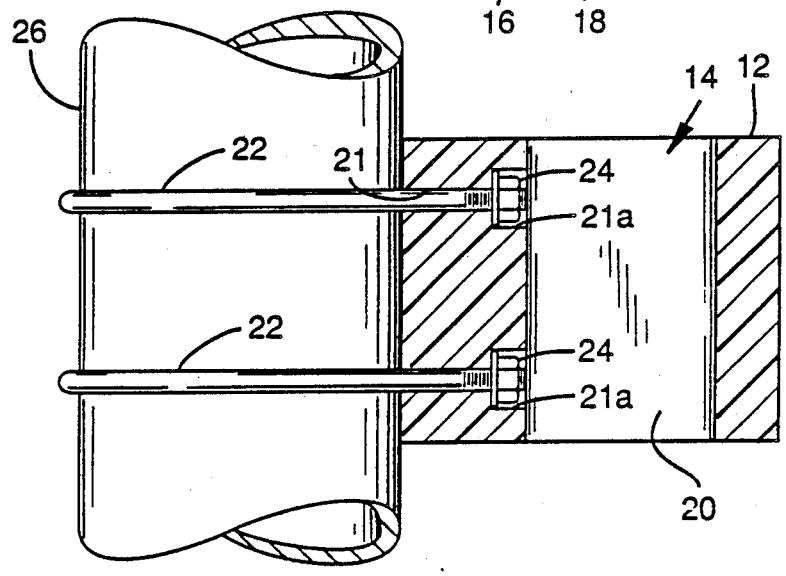
FIG. 3 is a cross sectional side view of the ski pole holder of FIG. 1 shown assembled and attached to a ski lift.

With reference to FIGS. 1–3, a ski pole holder 10 according to a principal embodiment of the present invention includes a resilient retainer body 12 having a T-shaped inner formation 14. Formation 14 includes an entry passage 16 defining an opening 18 and a retention passage 20 intersecting passage 16, where passage 16 corresponds to the vertical base of the T-shape and passage 20 corresponds to the horizontal cross portion of the T-shape. Holder 10 is manufactured by an extrusion process which produces lengths of rubber compound having a substantially square exterior cross-section with formation 14 appearing as a T-shape in lateral cross-section. The lengths of extruded rubber compound are cut in segments wherein each segment forms a body 12. Body 12 is then provided with mounting apertures 21 through which U bolts 22 are inserted, with nuts 24 being used to secure bolts 22 to holder 10. Apertures 21 are countersunk, as at 21*a*, to accommodate nuts 24 and maintain passage 20 clear. Holder 10 is mounted upon upright 26 (FIG. 3) by capturing upright 26 within the bight of bolts 22, inserting bolts 22 through apertures 21 and threading nuts 24 upon bolts 22.

Figure 4:
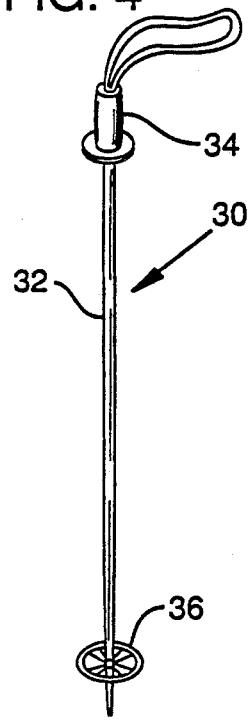
FIG. 4 illustrates a ski pole.

Referring to FIG. 4 in conjunction with FIGS. 1–3, ski pole 30 includes rod section 32 with handle 34 at its upper end and basket 36 at its lower end. Rod section 32 is of smaller diameter than the lower portion of handle 34 and formation 14 is wide enough to permit insertion of rod section 32 within passages 16 and 20 by way of opening 18, i.e., by lateral movement of pole 30, yet is narrow enough to prevent the lower portion of handle 34 from entering formation 14, i.e., by downward axial movement of pole 30, once rod section 32 is inserted in formation 14. Thus, rod section 32 is slidably received both axially and laterally within formation 14 while handle 34 is supported from below by the upper surface of holder 10.

Figure 5:
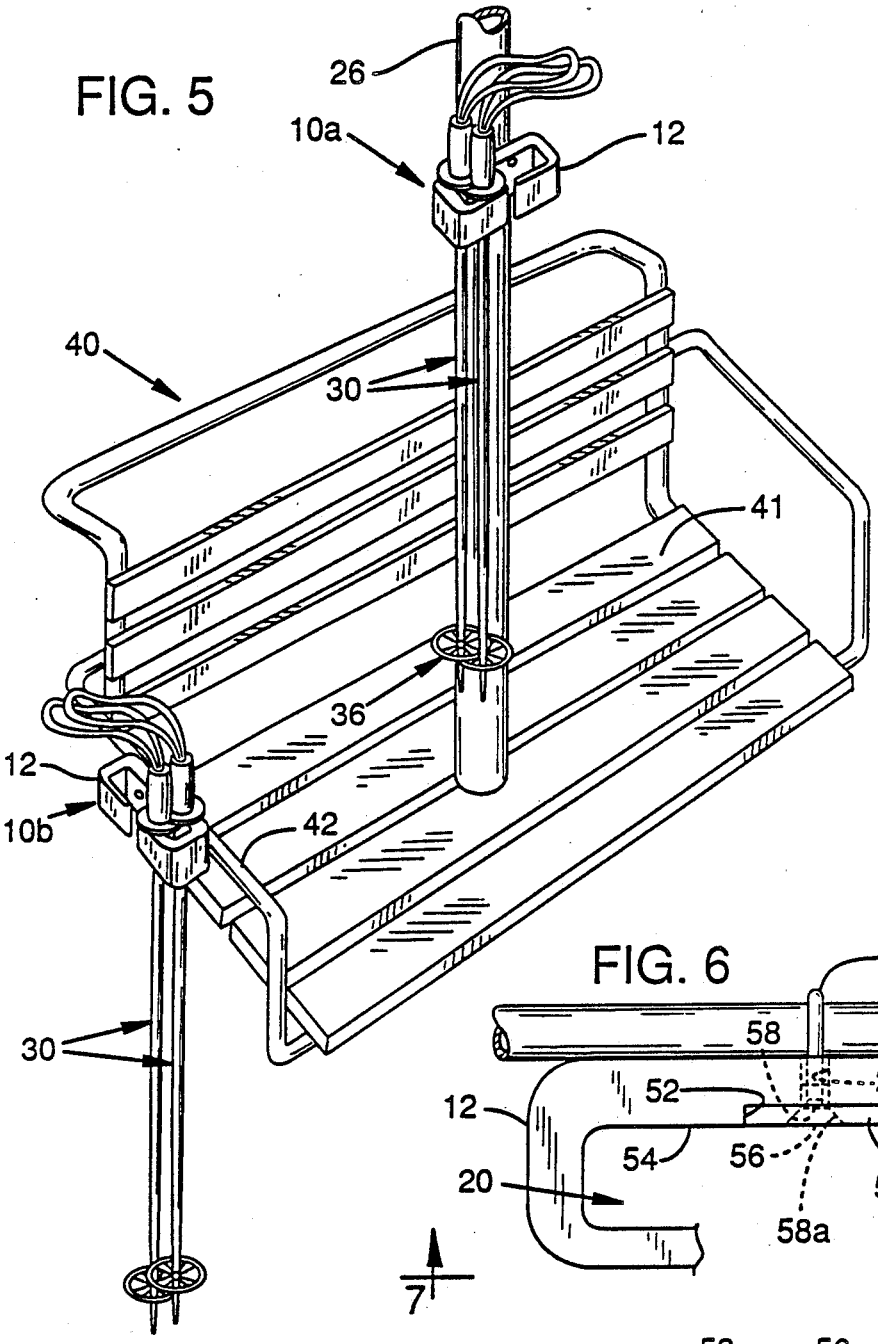
FIG. 5 is a perspective view of a ski lift showing mounting locations upon the ski lift for the ski pole holder of FIG. 1, and showing ski poles held within the ski pole holder.

FIG. 5 illustrates preferred mounting locations for holder 10 upon ski lift 40. In FIG. 5, holder 10*a* is affixed to upright 26 at sufficient height above seat 41 such that when ski poles 30 are held within holder 10, baskets 36 are above seat 41. Holder 10*b* is mounted to arm rest 42 of lift 40 and the orientation of bolts 22 and apertures 21 may be adjusted to accommodate the structure of arm 42. Thus, while holder 10*a* includes horizontally aligned apertures 21 for each U bolt 22, holder 10*b* would require vertically aligned apertures 21 for each U bolt 22.

Ski runs may be full runs, where the lift carries skiers from the bottom of the run to the top without any intermediate stops or unloading stations, or may include intermediate unloading stations where the lift comes close to ground or snow level to permit skiers to get off as the lift passes through. For lifts with intermediate unloading stations, the location shown for holder 10*a* is preferred as it is undesirable to permit baskets 36 to drag as the ski lift passes near ground level. For lifts without intermediate unloading stations, the location of holder 10*b* is preferred as this location is more convenient and the skiers may conveniently remove the poles from the holder before the lift reaches the unloading station at the top of the run. In the preferred embodiment holder 10 is resilient and even if poles 30 drag upon the ground or strike an object while held within holder 10, holder 10 will bend to avoid damage to the poles.

Figure 6:
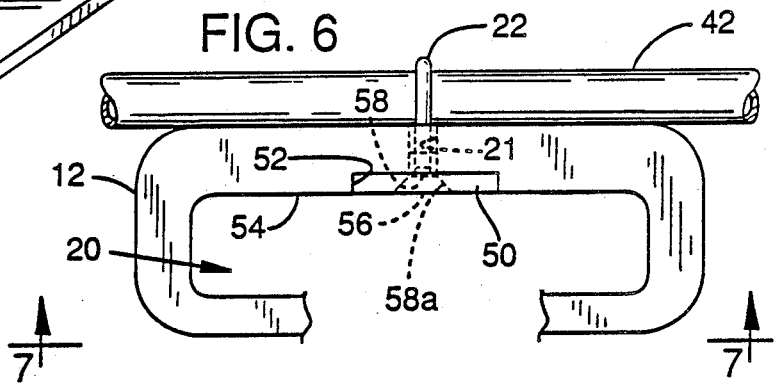
FIGS. 6 and 7 show an alternate method of securing the holder of FIG. 1.
Figure 7:
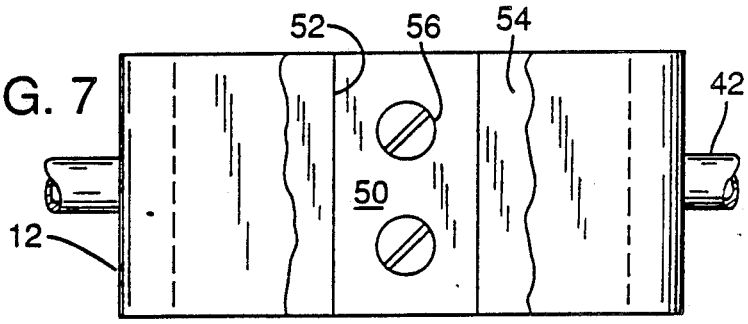

FIGS. 6 and 7 illustrate an alternative method of securing holder 10 wherein galvanized steel plate 50 is positioned within an inset 52 at the back wall 54 of passage 20 and nuts 24 (FIGS. 1–3) are replaced by flat-head nuts 56. Apertures 21 are straight bores through body 12 and are aligned with apertures 58 in plate 50 which are counter sunk, as at 58*a*, to accommodate flat-head nuts 56, nuts 56 being threaded internally for connection to bolts 22. Holder 10 is mounted to arm 42 by capturing arm 42 within the bight of bolts 22 and inserting bolts 22 through apertures 21. Plate 50 may positioned within inset 52 by inserting bolts 22 through apertures 58 and threading nuts 56 upon bolts 22. In this configuration, the threaded portions of bolts 22 are well protected within body 12 and nuts 56 while plate 50 is flush with the back wall 54 of passage 20 leaving passage 20 clear for unencumbered retention of ski poles. It is understood that the mounting arrangement shown in FIGS. 6 and 7 may be used to mount holder 10 upon a vertical structure, such as upright 26 of FIG. 3, by horizontal alignment of apertures 21 as shown in FIG. 1.

In operation, skiers board lift 40 with their poles in hand, and once seated upon the lift they place the poles within holder 10 by slipping rod section 32 through opening 18, passage 16 and into retention passage 20. Retention passage 20 is dimensioned to accommodate a number of poles depending on the number of passengers the lift is designed to carry. Ski lift 40 carries two passengers and retention passage 20 is dimensioned to fit four ski poles.

Thus, a ski pole holder has been shown which secures a skier's poles while the skier rides a ski lift thereby freeing the skier from the necessity of holding the poles in hand or sitting upon the poles.

While a preferred embodiment of the present invention has been shown and described, it will be apparent to those skilled in the art that many changes and modifications may be made without departing from the invention in its broader aspects. For example, body 12 may be secured to a ski lift by means other than bolts 22. The appended claims are therefore intended to cover all such changes and modifications as fall within the true spirit and scope of the invention.

I claim:

1. In combination, a ski lift and a holder adapted for holding a ski pole, the pole having a rod section defining a ski pole axis and a handle affixed to said rod section, the handle being of greater diameter than the rod section, the ski pole holder comprising:

a retainer having an interior formation including a base portion and a cross section, said formation being adapted for slidably receiving said rod section within said cross portion by way of said base portion, said cross section being dimensioned with respect to said rod section to permit said rod section to move within said cross portion both laterally and axially and to hold said handle against movement relative to said retainer in at least one axial direction, said retainer including spaced mounting apertures in a mounting portion thereof; and means for securing said retainer upon a ski lift, said securing means comprising a U-shaped bar having a bight portion adapted to partially surround a portion of said ski lift and spaced threaded end portions corresponding in spacing to the spacing of said mounting apertures of said retainer, a plate having spaced counter-sunk apertures corresponding in spacing to the spacing of said end portions, and nuts threadable upon said end portions, said nuts each including a portion adapted to fit within a portion of said countersunk apertures and a portion adapted to pass through said apertures for threading upon one of said end portions.

2. A combination according to claim 1 wherein said retainer is a resilient body.

3. A combination according to claim 1 wherein said formation is T-shaped.

4. A combination according to claim 1 wherein said plate is inset within said retainer.

5. In combination, a ski lift and a ski pole holder adapted for holding a ski pole, the pole having a rod section defining a ski pole axis and a handle affixed to said rod section, the handle being of greater diameter than the rod section, the ski pole holder comprising:

a retainer having an interior formation for slidably receiving said rod section both laterally and axially, said formation being smaller than said handle in at least one lateral direction for holding said handle against movement relative to said retainer in at least one axial direction when said handle contacts said retainer, said retainer including spaced mounting apertures in a mounting portion thereof; and means for securing said retainer upon said ski lift, said securing means comprising a U-shaped bar having a bight portion adapted to partially surround a portion of said ski lift and spaced threaded end portions corresponding in spacing to the spacing of said mounting apertures of said retainer, a plate having spaced counter-sunk apertures corresponding in spacing to the spacing of said end portions, and nuts threadable upon said end portions, said nuts each including a portion adapted to fit within a portion of said counter sunk apertures and a portion adapted to pass through said apertures.

6. A combination according to claim 5 wherein said retainer is a resilient body.

7. A combination according to claim 5 wherein said formation is T-shaped.

8. A combination according to claim 5 wherein said plate is insert within said retainer.

9. In combination, a ski lift and a holder adapted to hold a ski pole, the pole having a rod section and a handle affixed to the rod section, the handle being of greater diameter than the rod section, the holder comprising:

a retainer having, in lateral cross-section with respect to a longitudinal axis, an interior formation including a base portion and a cross portion, the base portion including an upper end portion intersecting the cross portion at the longitudinal axis and a lower end portion spaced from the upper portion, the lower end portion being open to receive the rod section when the rod section is substantially within an entry plane containing the longitudinal axis, the cross portion being dimensioned to receive the rod section by way of the upper end portion of the base portion and to permit both axial and lateral movement of the rod section within the cross portion, the cross portion being dimensioned to prevent entry of the handle therein, said retainer including mounting apertures; and means for securing the retainer upon a ski lift with the longitudinal axis substantially vertical whereby the rod section may inserted in the cross portion by way of the base portion with the handle positioned above the retainer such that the handle bears against the retainer and the ski pole thereby depends from the retainer, said securing means comprising a U bolt adapted to partially surround a portion of said ski lift and having threaded end portions each adapted to pass through a corresponding one of said mounting apertures of said retainer, a plate having counter sunk apertures, and nuts adapted to fit within said counter sunk apertures and pass through said countersunk apertures to thread upon said U bolt.

10. A combination according to claim 9 wherein the retainer holds a plurality of ski poles, the cross portion being dimensioned to receive a plurality of ski pole rod sections while preventing entry of ski pole handles.

11. A combination according to claim 9 wherein the retainer is a resilient body.

12. A combination according to claim 9 wherein the formation is a T-shaped formation.

13. A combination according to claim 9 wherein said cross portion is dimensioned to permit said rod section to move laterally with respect to said longitudinal axis within a second plane transverse to said entry plane.

* * * * *